US008684153B2

(12) United States Patent
Togiya

(10) Patent No.: US 8,684,153 B2
(45) Date of Patent: Apr. 1, 2014

(54) MEDIA PROCESSING DEVICE

(75) Inventor: Hajime Togiya, Gumma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/513,570

(22) PCT Filed: Nov. 19, 2010

(86) PCT No.: PCT/JP2010/070737

§ 371 (c)(1),
(2), (4) Date: Jun. 29, 2012

(87) PCT Pub. No.: WO2011/068048

PCT Pub. Date: Jun. 9, 2011

(65) Prior Publication Data

US 2012/0255829 A1 Oct. 11, 2012

(30) Foreign Application Priority Data

Dec. 3, 2009 (JP) ..... 2009-275854

(51) Int. Cl.
*G07F 7/04* (2006.01)
*G07F 9/10* (2006.01)

(52) U.S. Cl.
USPC ..... 194/206; 194/350

(58) Field of Classification Search
USPC ..... 194/206, 350; 312/35, 97, 119, 122, 312/127, 212, 270.3, 249.4, 301, 330.1; 209/534; 235/379; 902/9, 11–13
See application file for complete search history.

(56) References Cited

U.S. PATENT DOCUMENTS

| | | | | |
|---|---|---|---|---|
| 4,589,708 | A * | 5/1986 | Kokubo et al. | 312/71 |
| 4,905,840 | A * | 3/1990 | Yuge et al. | 209/534 |
| 5,909,792 | A * | 6/1999 | Gerlier et al. | 194/206 |
| 2008/0007146 | A1 * | 1/2008 | Hillman | 312/183 |

FOREIGN PATENT DOCUMENTS

| | | | |
|---|---|---|---|
| JP | 4-58390 | A | 2/1992 |
| JP | 9-235061 | A | 9/1997 |
| JP | 2001-6018 | A | 1/2001 |
| JP | 2007-94486 | | 4/2007 |
| JP | 2009-098835 | A | 5/2009 |
| JP | 2009-258929 | A | 11/2009 |

* cited by examiner

*Primary Examiner* — Mark Beauchaine
(74) *Attorney, Agent, or Firm* — Rabin & Berdo, P.C.

(57) ABSTRACT

Disclosed is a media processing device that offers ease of use in loading and removal of cartridges and is capable of aligning paper currency delivery units upon conveyance paths and paper currency delivery units upon cartridges with a high degree of precision. A cartridge loading frame (4) is configured such that the height of the lateral plate upon the cartridge handling side is less than or equal to half the height of the respective cartridges, and a plurality of partitions, which partition the storage positions of the respective cartridges, is disposed upon the lower portion thereof; a conveyance path (3) is located within a conveyance path frame (36) so as to expose media delivery units; and alignment pins and alignment apertures, which align the media delivery units upon each respective cartridge (5-9) and the media delivery units upon the conveyance path (3), are disposed upon the facing surfaces of each respective cartridge (5-9) and of the conveyance path frame (36), and fit respectively therewith.

11 Claims, 14 Drawing Sheets

MEDIA PROCESSING DEVICE

TECHNICAL FIELD

The present invention relates to a medium processing apparatus such as a banknote telling machine, and in particular relates to a medium processing apparatus equipped with detachable medium storage cassettes for storing a medium such banknotes.

BACKGROUND ART

As a related medium processing apparatus there is, for example, the apparatus described in Japanese Patent Application Laid-Open (JP-A) No. 2009-098835.

FIG. 14 is a side view illustrating an internal structure of a related apparatus described in JP-A No. 2009-098835, and FIG. 15 is a side view illustrating the apparatus in a state in which banknote storage cassettes have been pulled out.

In an apparatus as shown in FIG. 14 and FIG. 15, a customer interface section 31, a checking and authentication section 32, a temporary holding section 33, conveying paths 34*a*, 34*b*, 34*c*, 34*d*, 34*e*, and a conveying path (sorting conveying path) 3 including a sorting section are provided in an upper portion of the apparatus, and plural banknote storage cassettes (medium storage cassettes) 5 to 8 and a medium storage cassette (integrated stacking box type) 9 are loaded in a lower portion of the apparatus, in a row from the near side to the far side of the apparatus.

The conveying paths 34*a*, 34*b*, 34*c* configure a loop shaped path from the customer interface section 31, via the checking and authentication section 32 and the temporary holding section 33, and back again to the customer interface section 31, the conveying path 3 is provided in a straight line along the row of the banknote storage cassettes 5 to 8 and the medium storage cassette 9, and the conveying path 34*d* connects the conveying path 34*a* and the conveying path 3 together at a position at the near side of the checking and authentication section 32, and the conveying path 34*e* connects the conveying path 34*b* and the conveying path 3 together at a position at the far side of the checking and authentication section 32.

The following processing for banknote (medium) depositing and dispensing is performed by such a configuration. First, when depositing, banknote(s) that have been introduced by a customer into the customer interface section 31 are separated and conveyed one-by-one by the conveying path 34*a* to the checking and authentication section 32 where the banknotes are checked and authenticated for denomination, and such irregularities as counting and conveying irregularities are detected. Resulting banknotes deemed suitable for depositing are conveyed by the conveying path 34*b* to the temporary holding section 33 where they are temporarily held, however, banknotes whose denomination is not clear or which have been detected as having an irregularity and are therefore not deemed suitable for depositing are conveyed by the conveying paths 34*b*, 34*c* to the customer interface section 31 and returned to the customer.

When all of the introduced banknotes have been checked and authenticated, the amount of the checked banknotes is then displayed on a display section, not shown in the drawings, and when a customer acknowledges this amount and authorizes transaction to proceed, the banknotes that are being temporarily stored in the temporary holding section 33 are fed out one-by-one and conveyed back to the checking and authentication section 32 by the conveying path 34*b* and a denomination check is again performed in the checking and authentication section 32. After checking, the banknotes are then conveyed from the conveying path 34*a* into the conveying path 3 via the conveying path 34*d*, sorted according to the identified denominations by the sorting section on the conveying path 3 and then stored separately by denomination in the banknote storage cassettes 5 to 8.

In dispensing processing, banknote(s) are fed out according to the denomination and amount input by a customer from at least one of the banknote storage cassettes 5 to 8 to an operation section, not shown in the drawings, and the banknotes that have been fed out are conveyed to the checking and authentication section 32 by the conveying path 3, the conveying path 34*d*, and the conveying path 34*a*. After performing checks on such aspects as the denomination and count in the checking and authentication section 32, the banknotes are then conveyed to the customer interface section 31 by the conveying paths 34*b*, 34*c* and stacked, and when banknotes of the customer-input denomination and amount have been stacked in the customer interface section 31, a shutter on the customer interface section 31 is opened and the banknotes are paid out to the customer.

Banknote replenishment and collection for the banknote storage cassettes 5 to 8 is performed utilizing the medium storage cassette 9, however further explanation thereof is omitted.

DISCLOSURE OF INVENTION

Technical Problem

However, there are the following issues with related apparatuses as described above.

Namely, in a related apparatus a box shaped cassette loading frame 35 having an open face on the top face side is provided, and the plural banknote storage cassettes (medium storage cassettes) 5 to 8 and the medium storage cassette 9 are loaded into the cassette loading frame 35. An upper portion and a lower portion inside of the apparatus are also divided with banknote transfer sections (medium transfer sections) provided between the conveying path 3 and each of the cassettes 5 to 9, configuration is made such that the cassettes 5 to 9 are pulled out towards the near side of the apparatus together with the box shaped cassette loading frame 35 that has an open face on the top face side, as shown in FIG. 15, and configuration is made such that each of the cassettes 5 to 9 can be removed from the cassette loading frame 35 by then lifting each of the cassettes 5 to 9 upwards.

When each of the cassettes 5 to 9 have been loaded into the apparatus together with the cassette loading frame 35, there is a need to align their respective banknote transfer sections with the banknote transfer sections on the conveying path 3 side, therefore, the height h of the cassette loading frame 35 is accordingly made as high as possible, and a structure is adopted such that positioning of each of the cassettes 5 to 9 is performed by positioning sections, not shown in the drawings, at the upper end portion side, thereby suppressing vibration of the cassettes 5 to 9.

In the related apparatus, since the height of the cassette loading frame is high, each of the heavy cassettes 5 to 9 needs to be lifted upwards in order to remove each of the cassettes 5 to 9 from the cassette loading frame 35, and there are accordingly resulting issues of the handling characteristics being extremely awkward, and the accompanying danger of dropping the cassettes 5 to 9 during removal.

If the height h of the cassette loading frame 35 is lowered in order to facilitate removal of the cassettes 5 to 9, then since the positioning of each of the cassettes 5 to 9 is performed at an upper portion of the cassette loading frame 35, the separation distance between the positioning sections and the banknote transfer section provided to each of the cassettes 5 to 9 becomes large, and as a result banknote jams (medium jams) occur due to resulting vibration of the cassettes 5 to 9 or due to misalignment between the banknote transfer sections of the conveying path 3 and the banknote transfer sections of the cassettes 5 to 9 when the cassettes 5 to 9 are loaded into the apparatus together with the cassette loading frame 35.

The present invention is directed towards addressing these issues.

Solution to Problem

To do this, the present invention is a medium processing apparatus including: plural medium storage cassettes for storing a medium; a conveying path for conveying medium for storing in each of the medium storage cassettes, for sorting conveyed medium into each of the medium storage cassettes and for conveying medium fed out from each of the medium storage cassettes; medium transfer sections provided on the medium storage cassettes side and on the conveying path side, for performing transfer of medium for storing in each of the medium storage cassettes and performing transfer of medium fed out from each of the medium storage cassettes; and a cassette loading frame for loading with each of the medium storage cassettes, wherein the cassette loading frame has a structure in which the height of a side panel on the cassette loading frame on a cassette handling side is the height of each of the medium storage cassettes or less and plural dividing plates are further provided that divide a lower portion of the cassette loading frame into cassette storage positions.

Furthermore, the medium processing apparatus of the present invention is structured such that the conveying path is disposed in a conveying path frame, and the conveying path frame is rendered capable of being pulled out together with the cassette loading frame by attaching the conveying path frame to the cassette loading frame such that the conveying path frame is capable of opening and closing; and a positioning section is further provided such that when mutually opposing faces of each of the medium storage cassettes and the conveying path frame are fitted together positioning is performed to the medium transfer sections on the medium storage cassettes side and the medium transfer sections on the conveying path side.

Advantageous Effect of Invention

In the thus configured present invention, the height of the side panel on the cassette handling side of the cassette loading frame is low, and the positioning sections are provided in the vicinity of the banknote transfer sections of the conveying path and the banknote transfer sections of each of the cassettes so as to fit together, consequently, improved handling characteristics are achieved for loading or removing the medium storage cassettes to or from the cassette loading frame even though the medium storage cassettes are heavy, and positioning of the banknote transfer section of the conveying path side and the banknote transfer sections on the medium storage cassette side can be performed with good precision.

DESCRIPTION OF EMBODIMENTS

Explanation follows regarding an exemplary embodiment of a medium processing apparatus of the present invention, with reference to the drawings.

First Exemplary Embodiment

Figure 1:
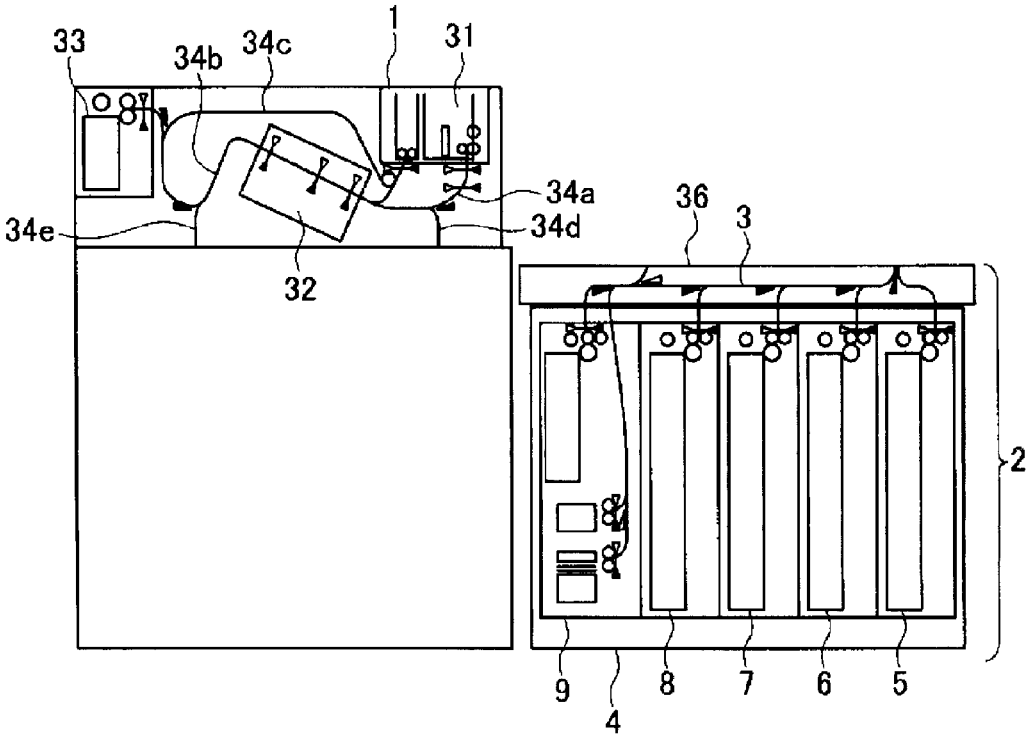
FIG. 1 is a side view of an exemplary embodiment illustrating a cassette in a pulled out state from an apparatus.

FIG. 1 is a side view of the internal structure of an exemplary embodiment, illustrating an example applied to a banknote telling machine, and showing a banknote storage cassette in a state pulled out from the apparatus. In FIG. 1, an upper unit 1 is provided with a customer interface section 31, a checking and authentication section 32, a temporary holding section 33, conveying paths 34*a*, 34*b*, 34*c*, 34*d*, 34*e*, and a conveying path 3.

A lower unit 2 includes: a conveying path 3; a cassette loading frame 4 that has a top face open; banknote storage cassettes (medium storage cassettes) 5 to 8 set out in a single row in the cassette loading frame 4 from the apparatus near side to the apparatus far side; and a medium storage cassette 9, the conveying path (sorting conveying path) 3 that includes a sorting section is disposed housed in a box shaped conveying path frame 36 having an open top face, and the conveying path frame 36 is attached to the cassette loading frame 4 so as to be able to open and close, and further details regarding this aspect are explained later.

A sliding rail is provided to a bottom section of the cassette loading frame 4, with the sliding rail engaged with a sliding rail on the apparatus side while not shown in the drawings, and the lower unit 2 including the cassette loading frame 4, the cassettes 5 to 9 and the conveying path frame 36 can be pulled out towards the apparatus near side or pushed into the apparatus using the two sliding rails.

Figure 14:
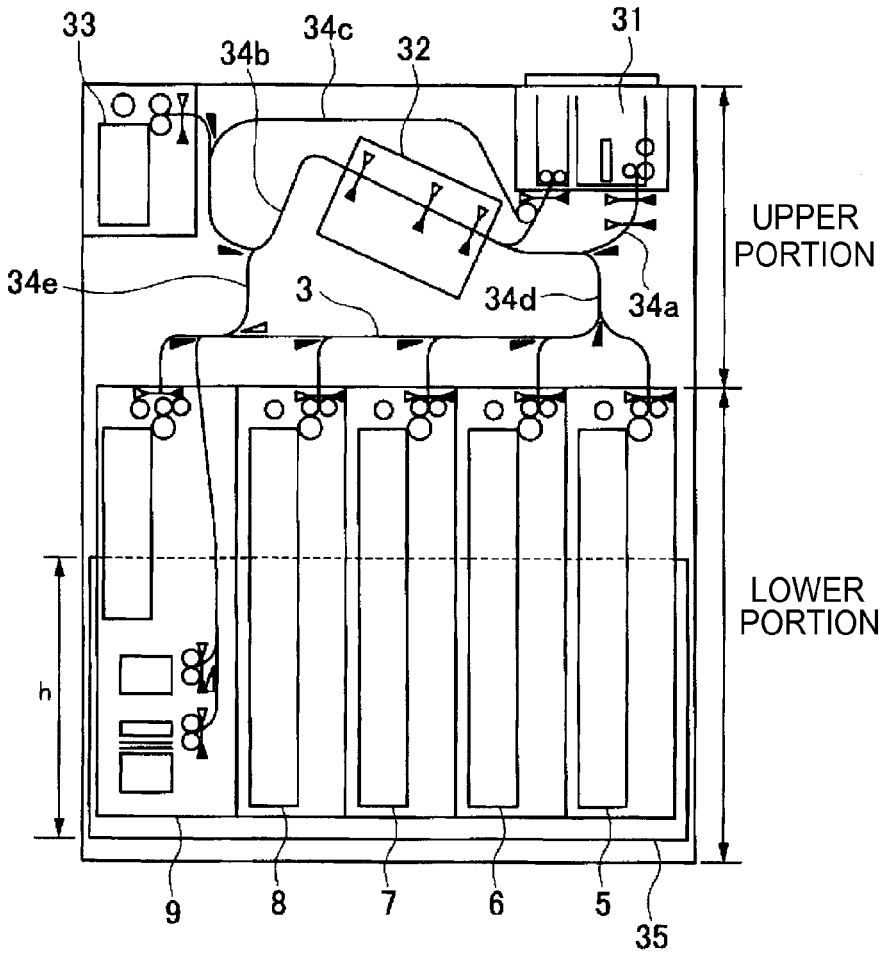
FIG. 14 is a side view illustrating internal structure of a related apparatus.
Figure 15:
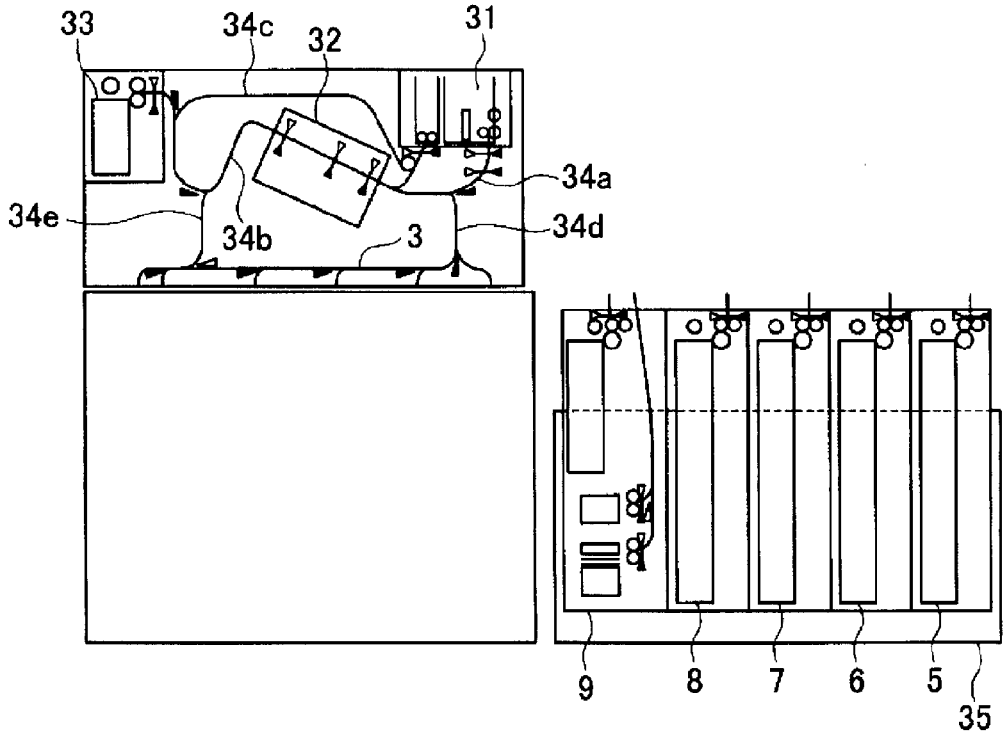
FIG. 15 is a side view of a related apparatus illustrating a state in which cassettes have been pulled out.

Note that the customer interface section 31, the checking and authentication section 32, the temporary holding section 33, the conveying paths 34*a*, 34*b*, 34*c*, 34*d*, 34*e*, the conveying path 3 and the banknote storage cassettes 5 to 8 and the medium storage cassette 9 are similar configuration elements to those of a related apparatus illustrated in FIG. 14 and FIG. 15.

Figure 2:
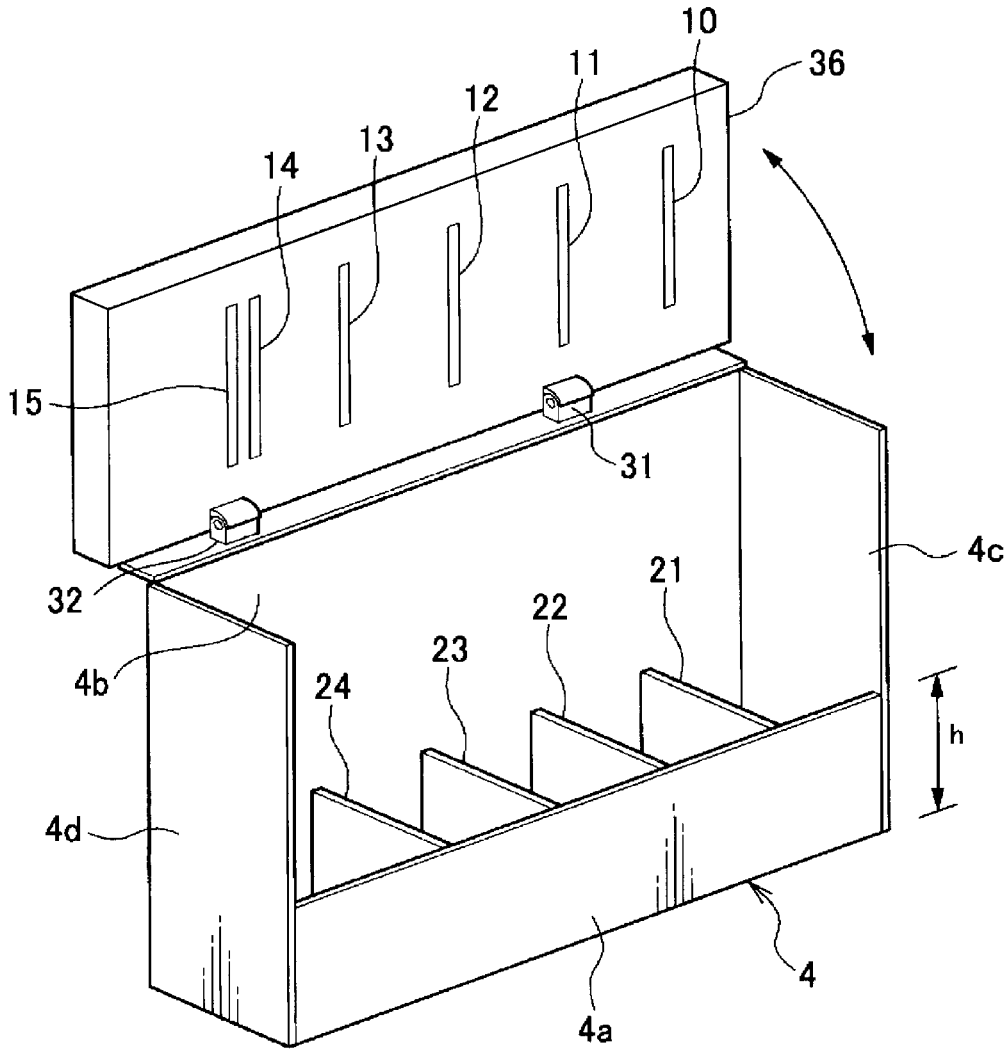
FIG. 2 is a perspective view of a cassette loading frame with opened conveying path frame in a first exemplary embodiment.
Figure 3:
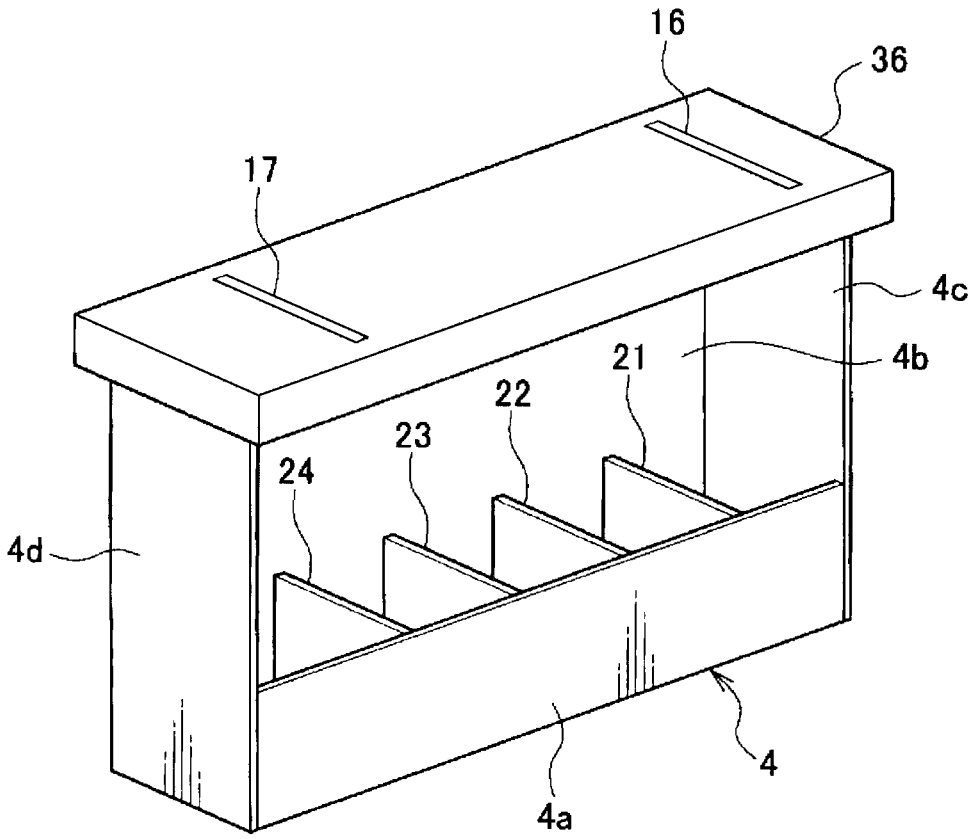
FIG. 3 is a perspective view of a cassette loading frame with closed conveying path frame in the first exemplary embodiment.
Figure 4:
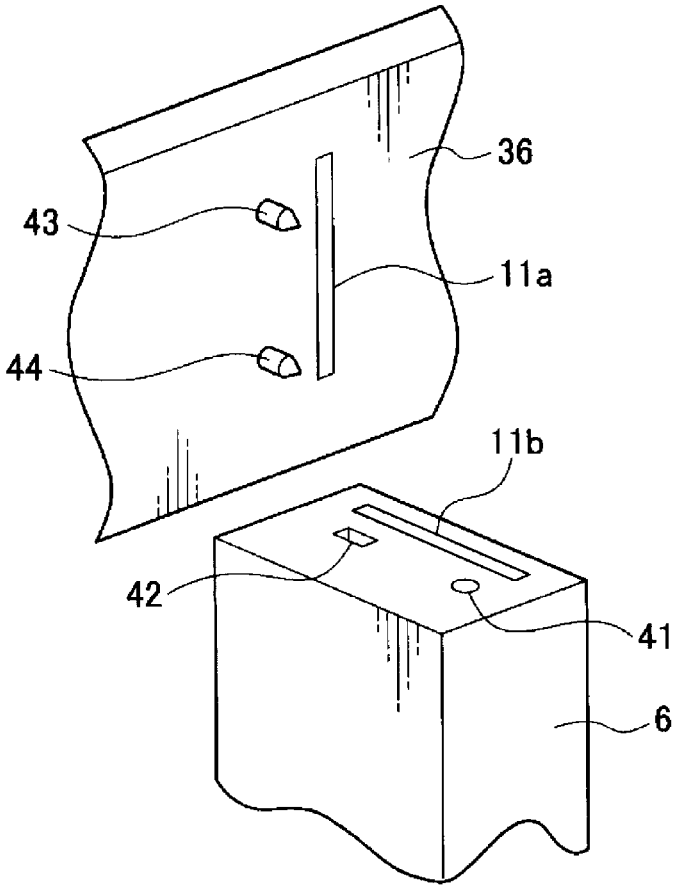
FIG. 4 is a perspective view of relevant portions of a banknote storage cassette with open conveying path frame in the first exemplary embodiment.
Figure 5:
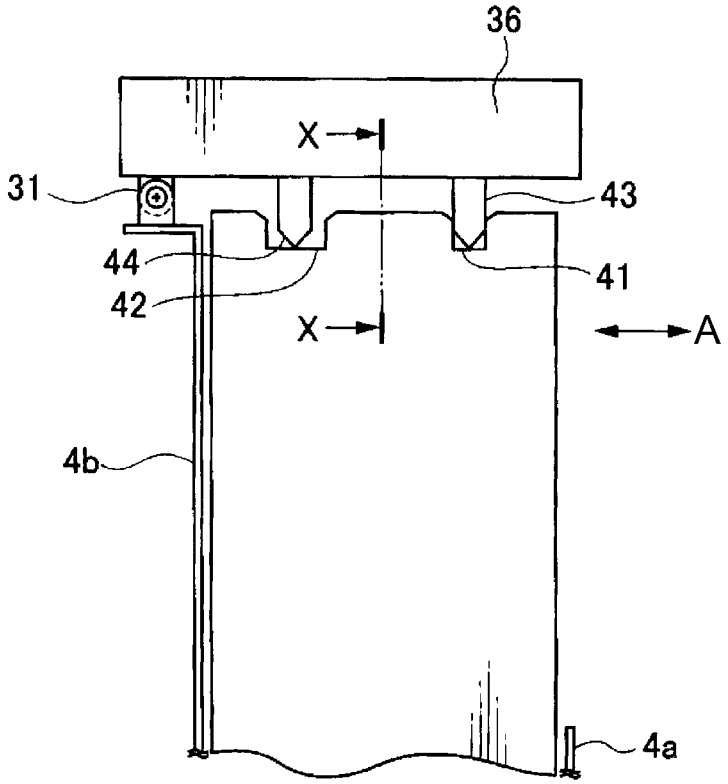
FIG. 5 is a back view of relevant portions with closed conveying path frame in the first exemplary embodiment.
Figure 6:
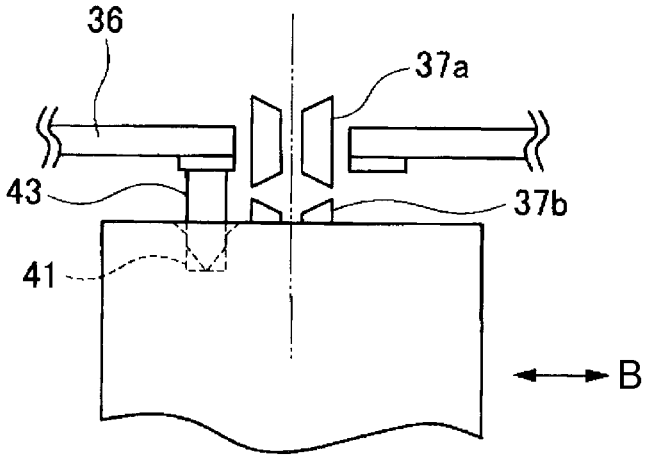
FIG. 6 is a cross-section taken on line X-X of FIG. 5.

FIG. 2 to FIG. 6 are drawings illustrating the first exemplary embodiment, FIG. 2 is a perspective view of the cassette loading frame 4 shown when the conveying path frame 36 is opened, FIG. 3 is a perspective view of the cassette loading frame 4 shown when the conveying path frame 36 is closed, FIG. 4 is a perspective view of relevant portions of the banknote storage cassette 6 shown when the conveying path frame 36 is opened, FIG. 5 is a back view of relevant portions shown when the conveying path frame 36 is closed, and FIG. 6 is a cross-section taken on line X-X of FIG. 5.

As shown in FIG. 2 and FIG. 3, the cassette loading frame 4 has a side panel 4*a* (as used herein, the side panel 4*a* may also be referred to as a first side panel) on a first side, this being the cassette handling side, of height h that is half the height of the cassettes 5 to 9 or less, and preferably about ⅓ the height thereof, the height of a side panel 4*b* (as used herein, the side panel 4*b* may also be referred to as a second side panel), on a second side that is the opposite side to the cassette handling side, is about the same as the height of the cassettes 5 to 9, plural lower dividing plates 21 to 24 are provided between a front panel 4*c* and a back panel 4*d* so as to divide up the lower portion of the cassette loading frame 4 into respective cassette storage positions, and the lower dividing plates 21 to 24 have heights that are about the same as the height of the side panel 4*a*, and are disposed at a separation from each other of the front-rear direction dimension of the cassettes 5 to 9.

The conveying path frame 36 is attached to the upper edge portion of the side panel 4*b* of the cassette loading frame 4, as shown in FIG. 2, so as to swing open or closed about support points 31, 32. Elongated guide holes 10 to 15 that are longer than the banknote width in a direction orthogonal to the banknote conveying direction are provided parallel to each other in the bottom face side of the conveying path frame 36, a respective banknote transfer section (transfer guide) 37*a* of the conveying path 3 is provided at each of the guide holes 10 to 15, as shown in FIG. 6, so as to be exposed to the cassette side, and banknote transfer sections 37*b* corresponding to the banknote transfer sections 37*a* are provided to the top face of the respective cassettes 5 to 9 so as to be exposed on the conveying path frame 36 side. Guide holes 16, 17 are also provided in the top face side of the conveying path frame 36 so as to correspond to banknote transfer sections of the conveying paths 34*b*, 34*c*, and banknote transfer sections similar to those of the banknote transfer sections 37*a* also provided to the guide holes 16, 17.

Positioning pins (positioning sections) 43, 44 are provide to the bottom face of the conveying path frame 36 at a specific separation from each other, so as to be positioned in the vicinity of for example the guide hole 11, namely in the vicinity of the banknote transfer sections 37*a*, as shown in FIG. 4 and FIG. 5, and positioning holes (positioning sections) 41, 42 are provided in the top face side of the banknote storage cassette 6 so as to align with the positioning pins 43, 44. Namely the positioning pins 43, 44 and the positioning holes (positioning sections) 41, 42 are provided to the mutually opposing faces of the conveying path frame 36 and the banknote storage cassette 6, respectively.

Circular conical profiled leading ends are provided to the positioning pins 43, 44, and the positioning hole 41 corresponding to the positioning pin 43 furthest from the pivot point of the conveying path frame 36 has a diameter lightly larger than the diameter of the positioning pin 43, and opening of the hole widens out in a taper profile. Further, the positioning hole 42 corresponding to the positioning pin 44 nearest to the pivot point of the conveying path frame 36 is formed as an elongated hole that widens out to the left and right in a taper shaped profile such that the movement path of the positioning pin 44 is permitted when the conveying path frame 36 is swung open or closed about the support points 31, 32.

Note that while not shown in the drawings, positioning pins 43, 44 provided at a specific separation from each other are similarly positioned in the vicinity of the guide holes 10, 12 to 15 of the conveying path frame 36, namely in the vicinity of the respective banknote transfer sections 37*a*, and similarly, there are positioning holes 41, 42 corresponding to positioning pins 43, 44 provided in the banknote storage cassettes 5, 7, 8 and the medium storage cassette 9.

Figure 7:
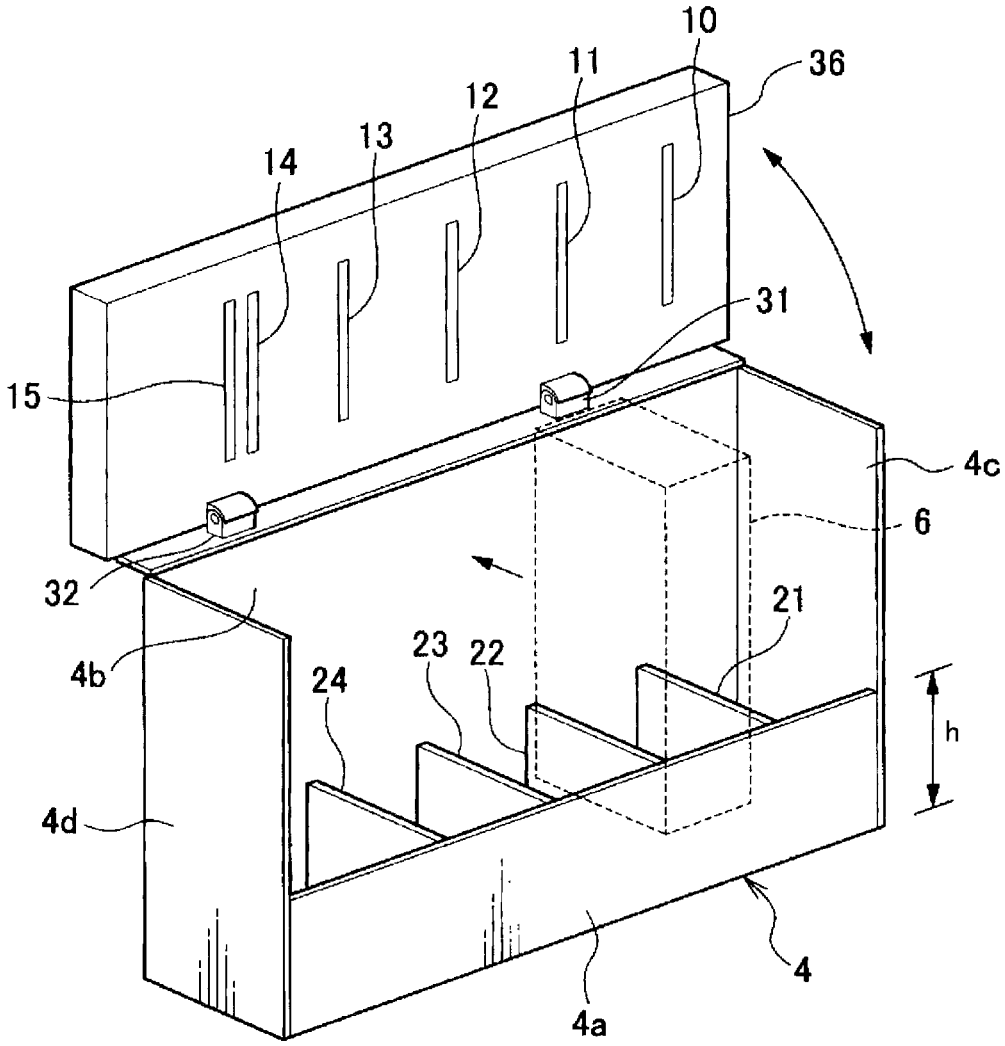
FIG. 7 is a perspective view illustrating operation of the first exemplary embodiment.

Explanation follows regarding operation of the first exemplary embodiment configured as described above. FIG. 7 is a perspective view illustrating operation of the first exemplary embodiment, and in order to load each of the cassettes 5 to 9 into the cassette loading frame 4 the conveying path frame 36 is swung open about the support points 31, 32 as illustrated, and the banknote storage cassette 6, for example, is lifted up and placed down in the cassette loading frame 4 between the lower dividing plates 21, 22. When performing this action the height h of the side panel 4*a* of the cassette loading frame 4 on the cassette handling side is half or less than half the height of each of the cassettes 5 to 9, for example about ⅓ the height of the cassettes 5 to 9, hence, the loading operation of lifting up the banknote storage cassette 6 and placing it down between the lower dividing plates 21, 22 of the cassette loading frame 4 can be easily performed. The removal operation when lifting up and removing the banknote storage cassette 6 from the cassette loading frame 4 can also be easily performed due to the low height h of the side panel 4*a*. It is possible to perform similar operations to load and remove the other cassettes 5, 7 to 9 into and out of the cassette loading frame 4.

When the conveying path frame 36 is swung closed about the support points 31, 32, as illustrated in FIG. 3, after each of the cassettes 5 to 9 have been loaded into the cassette loading frame 4, the positioning pins 43, 44 of the conveying path frame 36 fit into the positioning holes 41, 42 of the banknote storage cassette 6, as shown in FIG. 5 and FIG. 6. When this is performed, even if the banknote storage cassette 6 is somewhat misaligned in the left-right direction indicated by arrow A and/or in the front-rear direction indicated by arrow B, such misalignment in the cassette loading frame 4 is absorbed since the leading ends of the positioning pins 43, 44 is profiled in a conical cone shape and each of the insertion openings of the positioning holes 41, 42 is configured so as to widen out in taper profile. Further, the positioning pins 43, 44 and the positioning holes 41, 42 are also provided in the vicinity of the banknote transfer sections 37*a* of the conveying path 3 and the vicinity of the banknote transfer sections 37*b* of the cassettes 5 to 9, respectively, hence, positioning of the banknote transfer sections 37*a* and 37*b* with each other can be achieved with good precision by the positioning pins 43, 44 fitting into the positioning holes 41, 42.

After the above operation, the conveying path frame 36, the cassette loading frame 4, the banknote storage cassettes 5 to 8 and the medium storage cassette 9 are loaded into the apparatus by pushing the lower unit 2 into the apparatus, thereby the banknote transfer sections provided to the guide holes 16, 17 of the conveying path frame 36 with the banknote transfer sections of the conveying paths 34*b*, 34*c* are connected.

Cash depositing processing and cash withdrawal processing is performed in this state similarly as conventionally performed, however jams can be prevented from occurring in this section due to the banknote transfer sections 37*a* of the conveying path 3 and the banknote transfer sections 37*b* of the cassettes 5 to 9 each being positioned with good precision.

As explained above, in the first exemplary embodiment the height of the side panel on the cassette handling side of the cassette loading frame is made low, and the positioning sections for positioning the banknote transfer sections of the conveying path and the banknote transfer sections of each of the cassette are provided on the opposing faces of each cassette and the conveying path frame. Accordingly an effect is exhibited of obtaining a medium processing apparatus with good handling characteristics achieved for loading and removing the cassettes into and out of the cassette loading frame, and capable of positioning the banknote transfer sections of the conveying path and the banknote transfer sections of the cassettes with good precision.

Second Exemplary Embodiment

Figure 8:
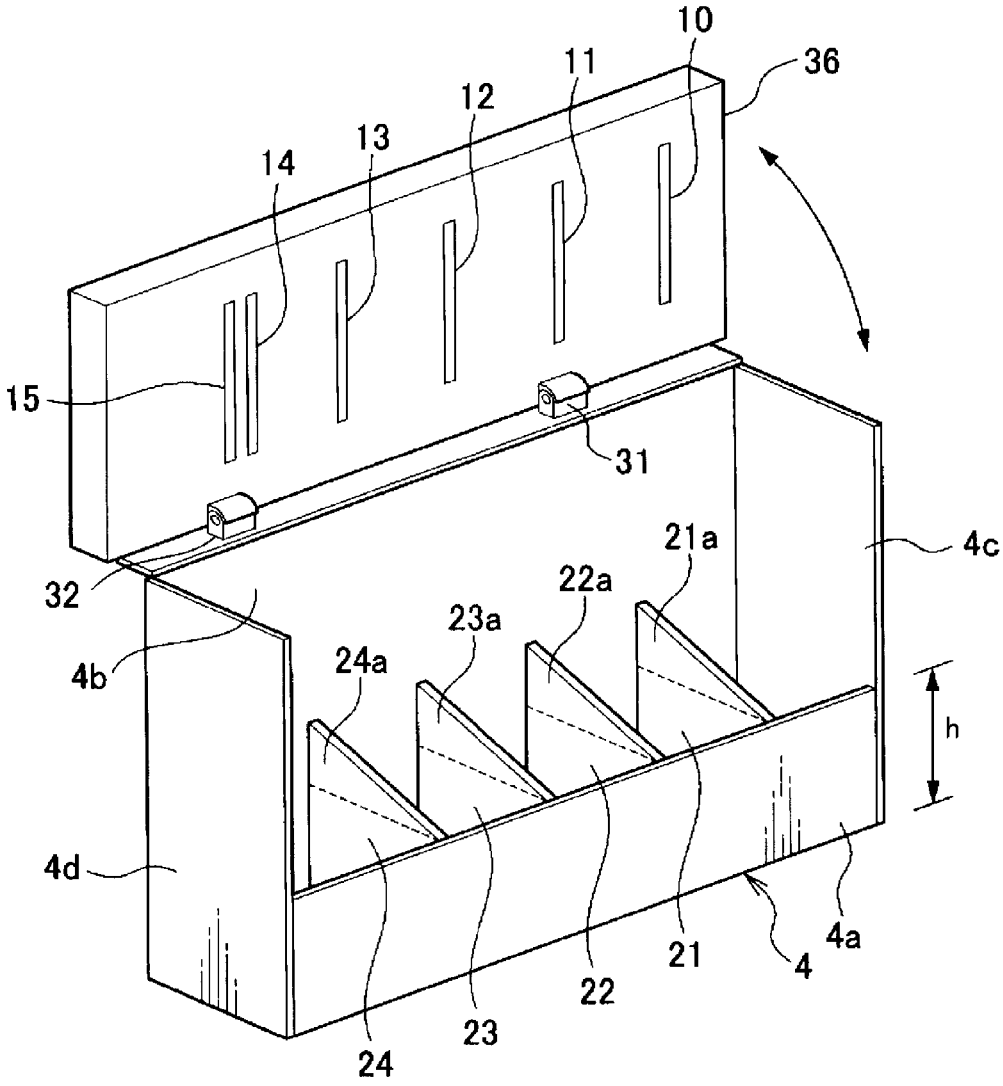
FIG. 8 is a perspective view of a cassette loading frame with opened conveying path frame in a second exemplary embodiment.

FIG. 8 is a diagram illustrating a second exemplary embodiment, and shows a perspective view of a cassette loading frame 4 when a conveying path frame 36 has been opened. The second exemplary embodiment is an embodiment in which the left and right hand side heights of lower dividing plates 21 to 24 provided in the cassette loading frame 4 are made different from each other. More specifically, the height of the lower dividing plates 21 to 24 on the side panel 4*b* side of the cassette loading frame 4 is set higher than the height on the side panel 4*a* side on the cassette handling side of the cassette loading frame 4, so as to configure right-angled triangular shaped guide portions 21*a* to 24*a*.

Other parts of the structure are similar to those of the first exemplary embodiment, and, while not shown in the drawings, the guide holes 10 to 15 are provided with respective banknote transfer sections (transfer guides) 37*a* of a conveying path 3 as illustrated in FIG. 6, and banknote transfer sections 37*b* corresponding to the banknote transfer sections 37*a* are provided on the top face side of the respective cassettes 5 to 9. Guide holes 16, 17 are also provided on the top face side of the conveying path frame 36 so as to correspond with the banknote transfer sections of the conveying paths 34*b*, 34*c*. Banknote transfer sections similar to the banknote transfer sections 37*a* are also provided to the guide holes 16, 17.

The bottom face of the conveying path frame 36 is also provided with positioning pins 43, 44 at a specific separation so as to be positioned in the vicinity of the guide hole 11, for example as shown in FIG. 4 and FIG. 5, namely in the vicinity of the banknote transfer section 37*a*. Provision of positioning holes 41, 42 in the banknote storage cassette 6 so as to align with the positioning pins 43, 44 is also similar to in the first exemplary embodiment.

In the thus configured second exemplary embodiment, in order to load each of the cassettes 5 to 9 into the cassette loading frame 4, the individual cassettes 5 to 9 are lifted up to the height of the side panel 4*a* of the cassette loading frame 4. When then pressed towards the side panel 4*b* side in this state, since the cassettes 5 to 9 are guided while being positionally restricted by the respective guide portions 21*a* to 24*a* of the lower dividing plates 21 to 24, the cassettes 5 to 9 can be loaded into their respective assigned positions. Similarly, when removing the cassettes 5 to 9 from the cassette loading frame 4, since the lower end of each of the cassettes 5 to 9 is positionally restricted by the guide portions 21*a* to 24*a*, cassettes being removed can be prevented from hitting and damaging adjacent cassettes.

Note that in the present exemplary embodiment too, obviously, positioning is performed by the positioning pins 43, 44 of the conveying path frame 36 fitting into the positioning holes 41, 42 of the cassettes 5 to 9 when the conveying path frame 36 is swung closed.

The second exemplary embodiment configured as explained above exhibits a similar effect to that of the first exemplary embodiment. In addition, since positional restriction and guiding is performed by the guide portions formed on the lower dividing plates when loading the cassettes into the cassette loading frame and when removing the cassettes from the cassette loading frame 4, an effect is exhibited of enabling the handling characteristics during loading and during removing each of the cassettes to be improved further.

Third Exemplary Embodiment

Figure 9:
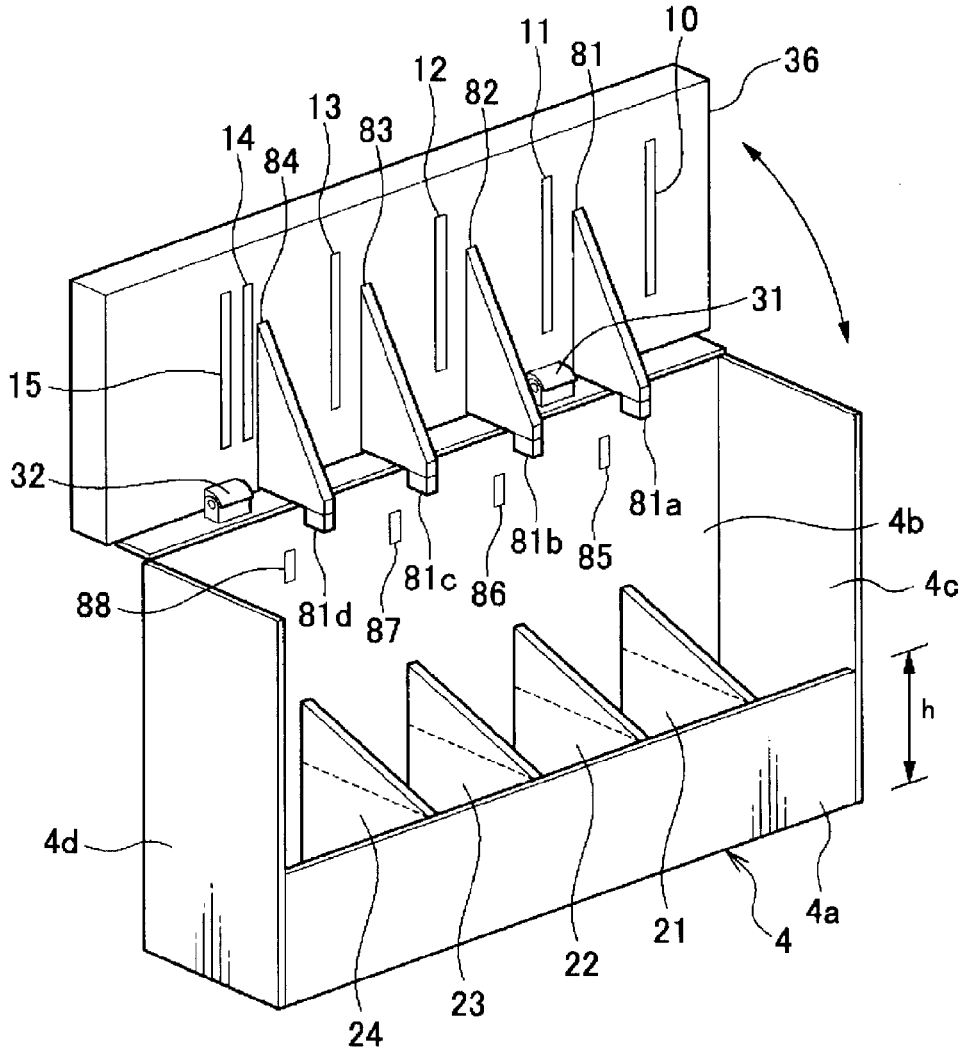
FIG. 9 is a perspective view of a cassette loading frame with opened conveying path frame in a third exemplary embodiment.
Figure 10A:
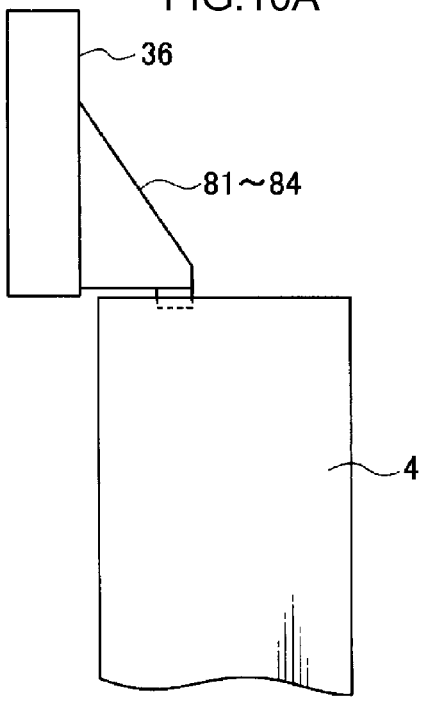
FIG. 10A is a back view of a cassette loading frame illustrating the operation of the third exemplary embodiment.
Figure 10B:
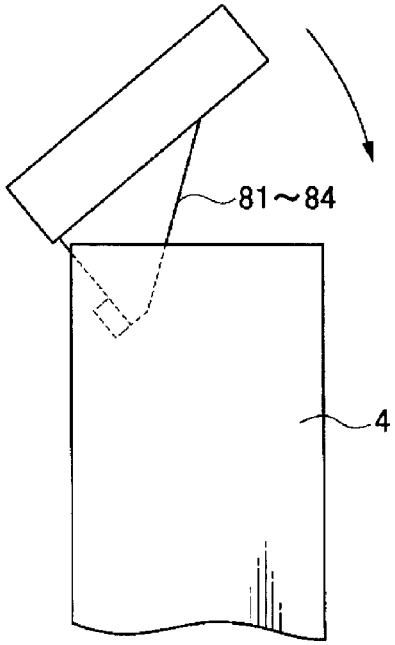
FIG. 10B is a back view of a cassette loading frame illustrating the operation of the third exemplary embodiment.

FIG. 9 is a diagram illustrating a third exemplary embodiment and is a perspective view of a cassette loading frame 4 when a conveying path frame 36 is open, and FIGS. 10A and 10B are rear face views of the conveying path frame 36 and the cassette loading frame 4 illustrating operation of the third exemplary embodiment. The third exemplary embodiment is an embodiment in which upper dividing plates 81 to 84 are provided on the bottom face of the conveying path frame 36 so as to be aligned with lower dividing plates 21 to 24 provided in the cassette loading frame 4. Each of the upper dividing plates 81 to 84 is formed in a substantially right angled triangular shape, with projections 81*a* to 84*a* at the leading ends (bottom ends) thereof. Relief holes 85 to 88 are provided to the side panel 4*b* of the cassette loading frame 4 for the projections 81*a* to 84*a* to escape into.

Other parts of the structure are similar to those of the second exemplary embodiment. In the third exemplary embodiment too, while not shown in the drawings, guide holes 10 to 15 are provided with respective banknote transfer sections (transfer guides) 37*a* of the conveying path 3 as illustrated in FIG. 6, and banknote transfer sections 37*b* corresponding to the banknote transfer sections 37*a* are provided on the top face side of the respective cassettes 5 to 9. Guide holes 16, 17 are also provided on the top face side of the conveying path frame 36 so as to correspond with the banknote transfer sections of the conveying paths 34*b*, 34*c*. Banknote transfer sections similar to the banknote transfer sections 37*a* are also provided to the guide holes 16, 17.

The bottom face of the conveying path frame 36 is also provided with positioning pins 43, 44 at a specific separation to each other so as to be positioned in the vicinity of the guide hole 11, for example as shown in FIG. 4 and FIG. 5, namely positioned in the vicinity of the banknote transfer section 37*a*. Provision of positioning holes 41, 42 in the banknote storage cassette 6 so as to align with the positioning pins 43, 44 is also similar to in the first and the second exemplary embodiment.

Thus in the third exemplary embodiment, similarly to in the second exemplary embodiment, when the conveying path frame 36 is swung closed about the support points 31, 32 after each of the cassettes 5 to 9 have been loaded into the cassette loading frame 4, the positioning pins of the conveying path frame 36 fit into the positioning holes 41, 42 of the cassettes 5 to 9 and positioning is accordingly performed. However when this occurs, the upper dividing plates 81 to 84 act to restrict the upper portions of the cassettes 5 to 9 as the conveying path frame 36 is being closed, as shown in FIG. 10A and FIG. 10B, enabling the positioning pins to be fitted smoothly into the positioning holes 41, 42. In a closed state of the conveying path frame 36, each of the projections 81*a* to 84*a* of the upper dividing plates 81 to 84 is inserted into the respective relief holes 85 to 88 provided to the side panel 4*b* of the cassette loading frame 4, accordingly suppressing vibration of the conveying path frame 36 such as due to external vibration.

In the third exemplary embodiment configured as explained above similar effects are exhibited to those of the second exemplary embodiment. In addition, the positioning pins are able to smoothly fit into the positioning holes due to providing the upper dividing plates provided to the conveying path frame, such that the upper dividing plates restrict the upper portion of the cassettes when the conveying path frame is being closed. An effect is obtained as a result of enabling positioning of the banknote transfer sections of the conveying path and the banknote transfer sections of the cassettes to be stably performed with good precision.

Fourth Exemplary Embodiment

Figure 11:
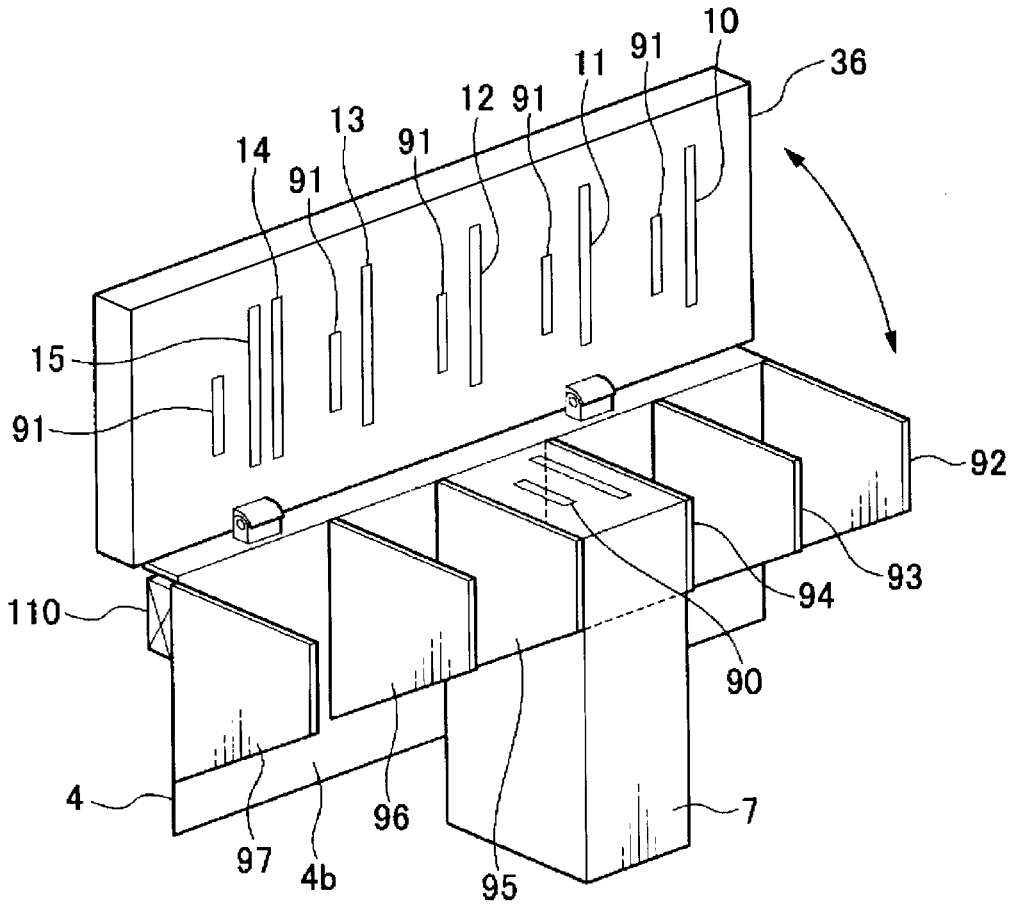
FIG. 11 is a perspective view of a cassette loading frame with opened conveying path frame in a fourth exemplary embodiment.
Figure 12:
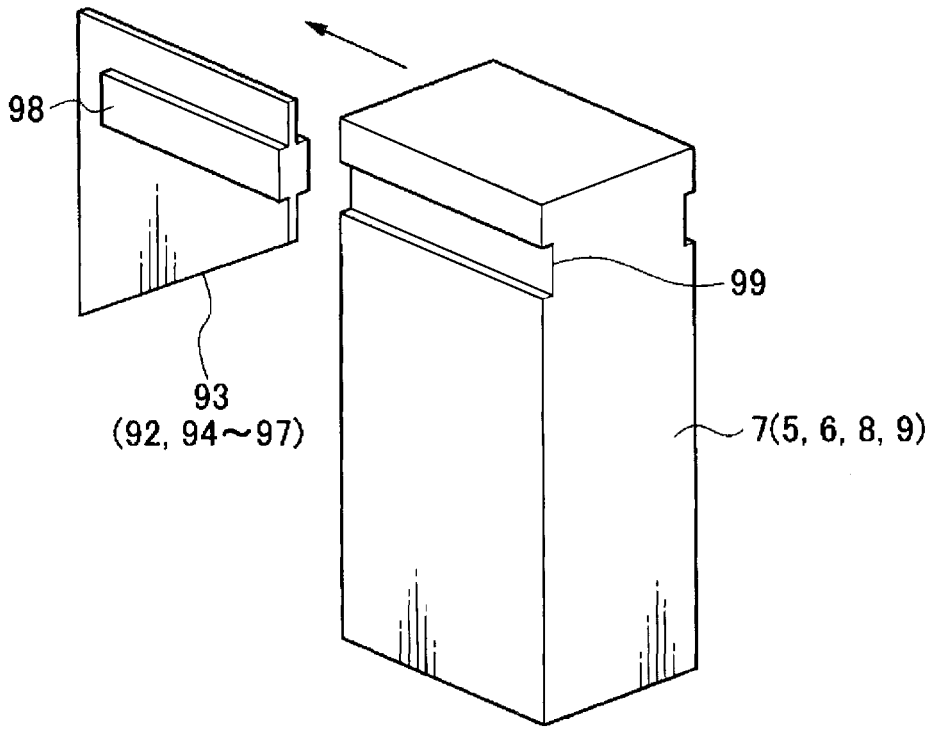
FIG. 12 is a perspective view of relevant portions of the fourth exemplary embodiment.

FIG. 11 is a diagram illustrating the fourth exemplary embodiment in a perspective view of a cassette loading frame 4 when a conveying path frame 36 has been opened, and FIG. 12 is a perspective view of relevant portions of the fourth exemplary embodiment. As shown in FIG. 11, in the fourth exemplary embodiment, the cassette loading frame 4 is configured with dividing plates 92 to 97 provided to a side panel 4*b* on the opposite side of the cassette loading frame 4 to the cassette handling side and separated from each other by the front-rear direction dimension of cassettes 5 to 9. The conveying path frame 36 is attached to the top edge portion of the side panel 4*b* so as to open and closed by swinging about support points 31, 32.

In the fourth exemplary embodiment, each of the cassettes 5 to 9 is loaded by inserting the upper portion of each of the cassettes 5 to 9 respectively between the dividing plates 92 and 93, between the dividing plates 93 and 94 and so on up to between the dividing plates 96 and 97. However, protruding portions 98 are provided with a specific length to the both faces of each of the dividing plates 92 to 97 in order to hang each of the cassettes 5 to 9 therefrom, and groove portions 99 are formed to the front and rear faces of each of the cassettes 5 to 9 for the protruding portions 98 to slidably fit into.

Jack style electrical contacts 90, 91 are provided on the top face of each of the cassettes 5 to 9 and on the bottom face of the conveying path frame 36 for fitting together. A slide rail 110 is also provided on the face of the side panel of the cassette loading frame 4 on the opposite side to the cassette installation face of the cassette loading frame 4. The slide rail 110 is provided for pulling out the lower unit 2 containing the cassette loading frame 4, the cassettes 5 to 9 and the conveying path frame 36 towards the near side of the apparatus or for pushing the lower unit 2 into the apparatus. The slide rail 110 engages with a slide rail, not shown in the drawings, on the apparatus side.

Other parts of the structure are similar to those of the first and second exemplary embodiment, and in the fourth exemplary embodiment too, while not shown in the drawings, guide holes 10 to 15 are provided with respective banknote transfer sections (transfer guides) 37*a* of the conveying path 3 as illustrated in FIG. 6, and banknote transfer sections 37*b* corresponding to the banknote transfer sections 37*a* are provided on the top face side of the respective cassettes 5 to 9. Guide holes 16, 17 are also provided on the top face side of the conveying path frame 36 so as to correspond to the banknote transfer sections of the conveying paths 34*b*, 34*c*. Banknote transfer sections similar to the banknote transfer sections 37*a* are also provided to the guide holes 16, 17.

The bottom face of the conveying path frame 36 is also provided with positioning pins 43, 44 at a specific separation from each other so as to be positioned in the vicinity of, for example, the guide hole 11 as shown in FIG. 4 and FIG. 5, namely the banknote transfer section 37*a*. Provision of positioning holes 41, 42 to the banknote storage cassette 6 so as to align with the positioning pins 43, 44 is also similar to in the first and the second exemplary embodiment.

In the thus configured fourth exemplary embodiment, each of the cassettes 5 to 9 is lifted up slightly, the protruding portions 98 of the dividing plates 92 to 97 are fitted into the groove portions 99 of each of the cassettes 5 to 9, and each of the cassettes 5 to 9 is loaded between the respective dividing plates 92 to 97 by pushing each of the cassettes 5 to 9 in against the side panel 4*b* of the cassette loading frame 4. Then when the conveying path frame 36 is swung closed about the support points 31, 32 the positioning pins of the conveying path frame 36 fit into the positioning holes 41, 42 such that positioning is performed. When this is being performed, the respective electrical contacts 90 provided on the top face of each of the cassettes 5 to 9 and the respective electrical contacts 91 provided on the bottom face of the conveying path frame 36 fit together so as to make a connection. Accordingly, when the lower unit 2 containing the cassette loading frame 4, the cassettes 5 to 9 and the conveying path frame 36 has been pushed into the apparatus then driving power can be supplied a banknote feed-out section or storing section provided on the respective cassette 5 to 9 side by, for example connecting the electrical contacts 91 on the conveying path frame 36 side to an apparatus power source.

In order to remove each of the cassettes 5 to 9 from the cassette loading frame 4, the conveying path frame 36 is opened and each of the cassettes 5 to 9 can then be easily removed by pulling out towards the near side.

Figure 13:
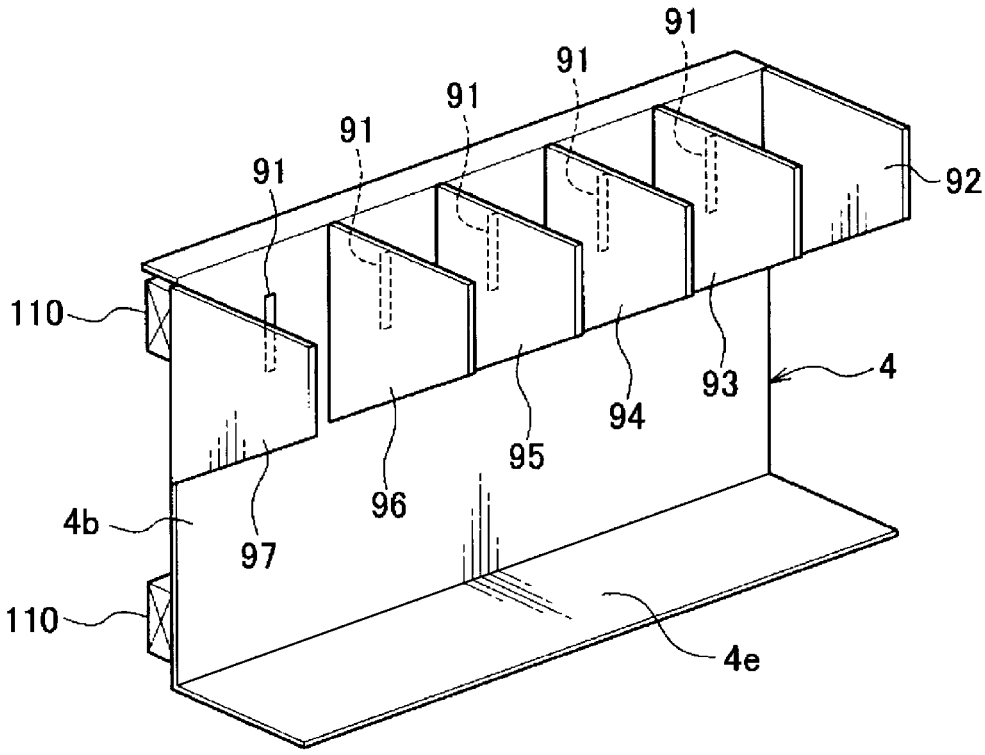
FIG. 13 is a perspective view illustrating another example of a cassette loading frame.

Note that while in the fourth exemplary embodiment the cassette loading frame 4 is configured with only the side panel 4*b* on the opposite side of the cassette loading frame 4 to the cassette handling side, configuration may be made with a structure such as that illustrated in FIG. 13. FIG. 13 is a perspective view illustrating another example of the cassette loading frame 4, with the cassette loading frame 4 configured with a side panel 4*b* and a bottom panel 4*e*.

Due to such provision of the bottom panel 4*e*, in order to load each of the cassettes 5 to 9, each of the cassettes 5 to 9 is placed on the bottom panel 4*e* and the protruding portions 98 of the respective dividing plates 92 to 97 are fitted into the groove portions 99 of the cassettes 5 to 9. The cassettes 5 to 9 can then be simply loaded between the respective dividing plates 92 to 97 by pressing each of the cassettes 5 to 9 in against the side panel 4*b* of the cassette loading frame 4.

In the fourth exemplary embodiment, the jack style electrical contacts 90, 91 are provided to the top face of each of the cassettes 5 to 9 and to the bottom face of the conveying path frame 36 for fitting together. However, the electrical contacts 91 may be provided to the side panel 4*b* of the cassette loading frame 4 so as to be positioned between the respective dividing plates 92 to 97, as illustrated in FIG. 13, and the electrical contacts 90 may be provided on the side face of each of the cassettes 5 to 9 that faces the side panel 4*b*. Accordingly, the electrical contacts 90, 91 can be fitted together and connected when each of the cassettes 5 to 9 has been loaded into the cassette loading frame 4.

Furthermore, for pulling out the lower unit 2 containing the cassette loading frame 4, the cassettes 5 to 9 and the conveying path frame 36 towards the near side of the apparatus or pushing the lower unit 2 into the apparatus, the handling characteristics for pulling out from the apparatus and pushing into the apparatus can be stabilized further by providing the slide rail 110 at both upper and lower levels of the face of the side panel of the cassette loading frame 4 that is on the opposite side to the cassette operation face, as shown in FIG. 13.

In the fourth exemplary embodiment as explained above, configuration is made with dividing plates provided separated from each other by the front-rear direction dimension of each of the cassettes on at least one of side panel of the cassette loading frame, protruding portions are provided with a specific length on each of the dividing plates, and groove portions are provided on the front and rear faces of each of the cassettes into which the protruding portions are capable of sliding and fitting. Since configuration is made such that each of the cassettes is can be loaded or removed by fitting the protruding portions into the groove portions and pushing each of the cassettes towards the side panel side of the cassette loading frame or pulling out the cassette therefrom, an excellent effect is exhibited in which superior handling characteristic are achieved due to each of the cassettes only needing to be lifted up slightly when loading or removing each of the cassettes.

Obviously, in the fourth exemplary embodiment too, the banknote transfer sections on the conveying path and the banknote transfer section on the cassettes can be positioned with good precision similarly to in the first to the third exemplary embodiments, due to provision of the positioning sections in the vicinity of the banknote transfer sections of the conveying path and the banknote transfer sections of the cassettes for fitting together.

Note that while in each of the exemplary embodiments described above the positioning pins 43, 44 for positioning the banknote transfer sections of the conveying path and the banknote transfer sections of the cassettes are provided to the conveying path frame 36, and the positioning holes 41, 42 corresponding to the positioning pins 43, 44 are provided to the cassettes 5 to 9, configuration may be made in which the positioning pins 43, 44 are provided to the cassettes 5 to 9 and the positioning holes 41, 42 are provided to the conveying path frame 36.

Furthermore, it is not essential to provide plural of the positioning pins and the positioning holes. Configuration is possible with a positioning section of a single elongated shaped positioning pin and a single elongated shaped positioning hole. Furthermore configuration is possible in which a small tab shaped plate and a slit are provided as a positioning section in place of a positioning pin and positioning hole.

Electrical contacts 90, 91 similar to those of the fourth exemplary embodiment may also be provided in the first to the third exemplary embodiments as described above.

Furthermore, while explanation has been given above of examples in which the above exemplary embodiments are applied to a banknote telling machine, application is possible to various types of apparatus that a medium processing apparatus equipped with plural medium storage cassettes and a conveying path.

The invention claimed is:

1. A medium processing apparatus comprising:

a plurality of medium storage cassettes, each of which stores media;

a conveying path that conveys media to be stored in each of the medium storage cassettes, sorts conveyed media into each of the medium storage cassettes, and conveys media fed out from each of the medium storage cassettes;

medium transfer sections provided at the medium storage cassettes, and at the conveying path, the medium transfer sections performing transfer of media to be stored in each of the medium storage cassettes and performing transfer of media fed out from each of the medium storage cassettes; and a cassette loading frame that loads each of the medium storage cassettes, the cassette loading frame being pullable in a pulling direction so as to move the cassette loading frame into a position to load and unload the medium storage cassettes therefrom, the cassette loading frame having a first side panel on one side of an orthogonal direction that is orthogonal to the pulling direction, and a second side panel at an opposite side of the orthogonal direction than the first side panel, a height of the first side panel being smaller than both of a height of the medium storage cassettes and a height of the second side panel, and a plurality of lower dividing plates that divide a lower portion of the cassette loading frame into cassette storage positions.

2. The medium processing apparatus of claim 1, wherein each of the lower dividing plates is formed with a shape that is lower at the one side than a shape of the lower dividing plates at the opposite side to form guide portions, and each of the medium storage cassettes is guided by the guide portions when each of the medium storage cassettes is loaded into or removed from the cassette loading frame.

3. The medium processing apparatus of claim 1, wherein the conveying path includes a sorting conveying path, and the medium processing apparatus further comprises a conveying path frame that the sorting conveying path is disposed within such that the medium transfer sections are exposed, and the conveying path frame is rendered capable of being pulled out together with the cassette loading frame by attaching the conveying path frame to the cassette loading frame such that the conveying path frame is capable of opening and closing; and a positioning section is further provided such that, when a face of each of the medium storage cassettes opposes and is fitted with a face of the conveying path frame, positioning is performed to the medium transfer sections on the medium storage cassettes side and the medium transfer sections on the conveying path side.

4. The medium processing apparatus of claim 3, wherein the conveying path frame further comprises upper dividing plates provided to so as to be aligned with the lower dividing plates.

5. The medium processing apparatus of claim 3, wherein an electrical contact is provided to each of the medium storage cassettes; and electrical contacts are provided to the conveying path frame, the electrical contacts provided to the conveying path frame making a mutual connection with the electrical contacts provided to the medium storage cassettes when the conveying path frame has been closed.

6. The medium processing apparatus of claim 3, an electrical contact is provided to each of the medium storage cassettes; and electrical contacts are provided to the cassette loading frame, the electrical contacts provided to the medium storage cassettes making a mutual connection with electrical contacts provided to the cassette loading frame when each of the medium storage cassettes has been loaded into the cassette loading frame.

7. A medium processing apparatus comprising:

a plurality of medium storage cassettes, each of which stores media;

a conveying path that conveys media to be stored in each of the medium storage cassettes, sorts conveyed media into each of the medium storage cassettes, and conveys media fed out from each of the medium storage cassettes;

medium transfer sections that are provided at the medium storage cassettes and at the conveying path, and perform transfer of media to be stored in each of the medium storage cassettes and perform transfer of media fed out from each of the medium storage cassettes; and a cassette loading frame that loads each of the medium storage cassettes, the cassette loading frame being pullable in a pulling direction so as to move the cassette loading frame into a position to load and unload the medium storage cassettes therefrom, the cassette loading frame having a first side panel on one side of an orthogonal direction that is orthogonal to the pulling direction, a second side panel at an opposite side of the orthogonal direction than the first side panel, a height of the first side panel being smaller than both of a height of the medium storage cassettes and a height of the second side panel, and a plurality of dividing plates provided so as to divide the side panel into respective cassette storage positions.

8. The medium processing apparatus of claim 7, wherein an electrical contact is provided to each of the medium storage cassettes; and electrical contacts are provided to the cassette loading frame, the electrical contacts provided to the medium storage cassettes making a mutual connection with the electrical contacts provided to the cassette loading frame when each of the medium storage cassettes has been loaded into the cassette loading frame.

9. The medium processing apparatus of claim 7, wherein the conveying path includes a sorting conveying path, and the medium processing apparatus further comprises:

a conveying path frame that the sorting conveying path is disposed within, and the conveying path frame is rendered capable of being pulled out together with the cassette loading frame by attaching the conveying path frame to the cassette loading frame such that the conveying path frame is capable of opening and closing; and a positioning section is further provided such that, when a face of each of the medium storage cassettes opposes and is fitted with a face of the conveying path frame, positioning is performed to the medium transfer sections on the medium storage cassettes side and the medium transfer sections on the conveying path side.

10. The medium processing apparatus of claim 9, wherein an electrical contact is provided to each of the medium storage cassettes; and electrical contacts are provided to the conveying path frame, the electrical contacts provided to the conveying path frame making a mutual connection with the electrical contacts provided to the medium storage cassettes when the conveying path frame has been closed.

11. A medium processing apparatus comprising:

a plurality of medium storage cassettes, each of which stores media;

a conveying path that conveys and sorts media to be stored in each of the medium storage cassettes, and conveys media that is fed out from each of the medium storage cassettes;

medium transfer sections provided at the medium storage cassettes and the conveying path, the medium transfer sections performing transfer of the media to be stored in each of the medium storage cassettes and performing transfer of the media that is fed out from each of the medium storage cassettes; and a cassette loading frame that loads each of the medium storage cassettes, the cassette loading frame being pullable in a pulling direction so as to move the cassette loading frame into a position to load and unload the medium storage cassettes therefrom, the cassette loading frame having a first side panel on an orthogonal direction that is orthogonal to the pulling direction, and a second side panel disposed opposite the first side panel on the orthogonal direction, a height of the first side panel being smaller than both of a height of the medium storage cassettes and a height of the second side panel; and a plurality of lower dividing plates that divide a lower portion of the cassette loading frame into cassette storage positions.

* * * * *